United States Patent [19]

Grant

[11] 4,312,509

[45] Jan. 26, 1982

[54] GOLF PUTTER

[76] Inventor: R. M. Grant, 179A Haywardville Rd., East Haddam, Conn. 06423

[21] Appl. No.: 144,931

[22] Filed: Apr. 29, 1980

[51] Int. Cl.[3] ..... A63B 53/04

[52] U.S. Cl. ..... 273/167 A; 273/167 F

[58] Field of Search ..... 273/77 R, 80 C, 167–175, 273/163 R, 164, 183 D, 193 R, 194 R; D21/217, 218

[56] References Cited

U.S. PATENT DOCUMENTS

| | | | |
|---|---|---|---|
| D. 240,245 | 6/1976 | Aragona | 273/167 A X |
| 1,541,126 | 6/1925 | Dunn | 273/167 A |
| 1,703,199 | 2/1929 | McClure | 273/167 G X |
| 3,064,975 | 11/1962 | Smith | 273/167 A X |
| 4,140,318 | 2/1979 | Izett et al. | 273/167 A |

FOREIGN PATENT DOCUMENTS

| | | | |
|---|---|---|---|
| 377463 | 7/1932 | United Kingdom | 273/167 A |

*Primary Examiner*—Richard J. Apley
*Attorney, Agent, or Firm*—Albert W. Hilburger

[57] ABSTRACT

A golf putter including a shaft and an integral ball striking head so configured that a player utilizing the putter is automatically caused to place his hands on the handle of the shaft in a region forward of the ball about to be struck. For this purpose, the ball striking head is provided with a pair of parallel lower base elements transverse to the longitudinal axis of the shaft, one adjacent to a forward face of the club head, and one adjacent to the rearward face of the club head. When the shaft is in an upright position and the rearward lower base element engages the ground, the forward lower base element is spaced from the ground. In this situation, gravity tends to cause the shaft to rotate forwardly and downwardly about the rearward lower base element resulting in simultaneous movement of the foward lower base element toward engagement with the ground. At such point that the forward and rearward lower base elements simultaneously engage the ground, the forward face of the club head is preferably inclined backward from the vertical within a range of approximately 0° to 4°.

9 Claims, 14 Drawing Figures

GOLF PUTTER

BACKGROUND OF THE INVENTION

1. Field of the Invention

The present invention relates generally to a golf putter, and more particularly, to an improved golf putter which increases the ability of a golfer to produce a firm, proper putting stroke, time after time.

2. Description of the Prior Art

A primary reason that putting is so difficult for golfers is the inability of a golfer to be consistent in positioning his hands. The hands serve as the fulcrum for the swing and it is axiomatic that a small difference in the location of the golfer's hands can result in a large difference at the end of the club shaft approximately 34" away.

Over the years, a variety of attempts have been made to increase the consistency and repeatability of a golfer's putting stroke. In one instance, known to the applicant, namely, U.S. Patent to Dunn, U.S. Pat. No. 1,541,126, there is a disclosure of a metallic golf club, though not a putter, formed with a concave sole resulting in a raised center of gravity of the club head such that it lies in the same plane as the center of gravity of a golf ball. In the patents to Reuter, Jr., U.S. Pat. No. 3,652,093, Lawrence, et al, U.S. Pat. No. 3,976,299, and Borah, U.S. Pat. No. 3,343,839 a variety of shapes and constructions of club heads are disclosed, including provision of fixed weights, or alternatively, changeable weights to achieve optimum balance, and therefore control of the club head. Other shapes and constructions of club heads have been suggested, such as in the patent to Preuter, U.S. Pat. No. 4,121,833, in which a rear portion of the club head has a cut out undersurface or such as disclosed by Schmidt, No. 2,843,384, in which the undersurface of the club head slopes upwardly and rearwardly. In yet another construction for improving balance of the club and therefore resulting in a high degree of control, the patent to Dalton, U.S. Pat. No. 4,138,117, discloses a relationship of the shaft and the club head being such that the longitudinal axis of the shaft passes through the axis of the club head.

With proper deference being given to the aforesaid patents, each of which, on its face, disclosed advances in the state-of-the-art of the construction of golf clubs when each respective patent was granted, nonetheless, the present invention is deemed to be a considerable improvement over such known devices. Indeed, it was with recognition of the need and of the state of the prior art that the present invention was conceived and has now been reduced to practice.

SUMMARY OF THE INVENTION

To this end, a golf putter is disclosed which includes a shaft and an integral ball striking head so configured that a player utilizing the putter is automatically caused to place his hands on the handle of the shaft in a region forward of the ball about to be struck. It is well known that by placing the hands of the golfer ahead of the ball, the back of the left hand (for a right handed golfer) is caused to assume a convex shape slightly tightening the left hand grip. With such a slightly tighter left hand grip, a more affirmative stroke through the ball is achieved thereby increasing the likelihood of a firmly struck, smoother rolling ball and increasing the golfer's chances of making the putt. For this purpose, the ball striking head is provided with a pair of parallel lower base elements transverse to the longitudinal axis of a shaft, one adjacent to a forward face of a club head, and one adjacent to the rear face of the club head. When the shaft is in an upright position and the lower base element engages the ground, the forward lower base element is spaced from the ground. In this situation, gravity tends to cause the shaft to rotate forwardly and downwardly about the rearward lower base element resulting in simultaneous movement of the forward lower base element toward engagement with the ground. At such point that the forward and rearward lower base elements simultaneously engage the ground, the forward face of the club head is preferably inclined backward from the vertical within a range of approximately 0° to 4°. This range of backward inclination is generally considered to be the ideal loft range of a putter.

With superior hand position at address, that is, with the golfer's hands positioned ahead of the ball immediately prior to initiating the stroke, a "breakdown" of the putting stroke will not be likely to occur as evidenced when the right hand passes over the left hand. The present invention enables the golfer to propel the ball with a crisp affirmative stroke, the club head picking up speed as it passes through the ball's initial position.

Thus, a primary feature of the invention is to provide a golf putter which automatically encourages a person to place his hands ahead of the ball at address in order to deliver the desired crisp, affirmative stroke through the ball. Simultaneously, the invention automatically causes the ball striking face of the club head to assume a desirable loft angle at address. Yet another feature of the invention is the provision of an improved golf putter which insures repeatability of the desired position of the golf's hands at address. At the same time that the present invention offers the above listed features, it is aesthetically pleasing, of simple construction, inexpensive to manufacture, and easy to use.

Other and further features, objects, advantages, and benefits of the invention will become apparent from the following description taken in conjunction with the following drawings. It is to be understood that both the foregoing general description and the following detailed description are exemplary and explanatory but are not restrictive of the invention. The accompanying drawings which are incorporated in and constitute a part of this invention, illustrate one embodiment of the invention and, together with the description, serve to explain the principles of the invention.

DETAILED DESCRIPTION OF THE DRAWINGS

DESCRIPTION OF THE PREFERRED EMBODIMENTS

Figure 1:
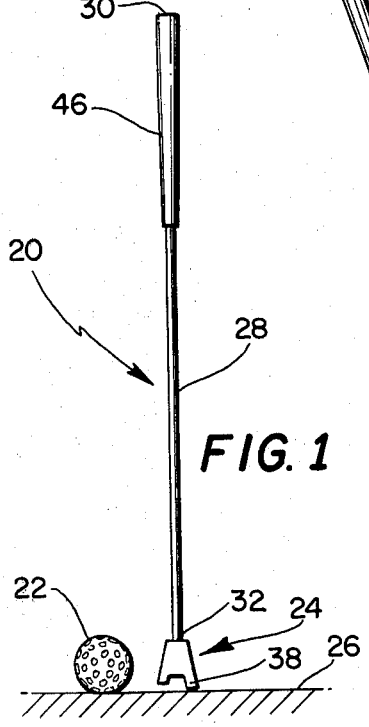
FIG. 1 is a side elevation view of a golf putter embodying the invention prior to being placed in service.
Figure 2:
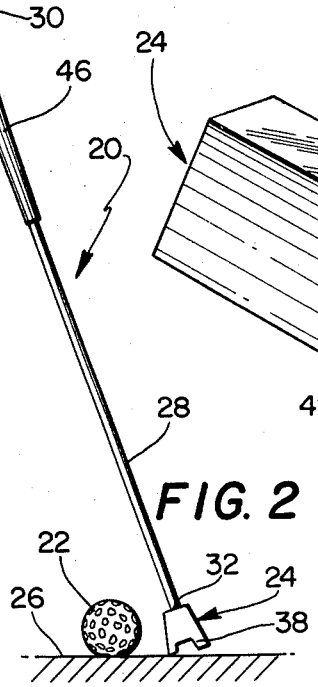
FIG. 2 is a side elevation view of the golf putter illustrated in FIG. 1 positioned at address.
Figure 3:
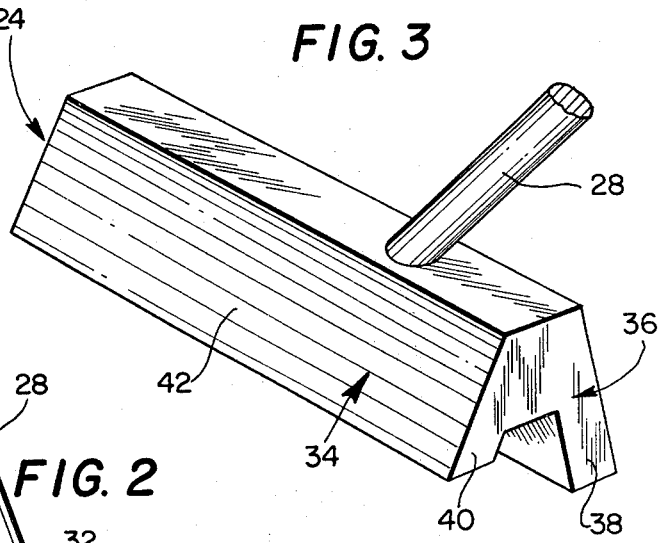
FIG. 3 is a detail perspective view of a ball striking head which forms part of the invention.
Figure 4:
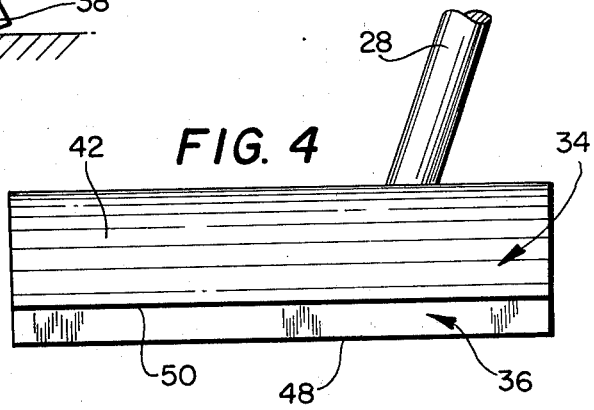
FIG. 4 is a front elevation view of the part illustrated in FIG. 3.
Figure 5:
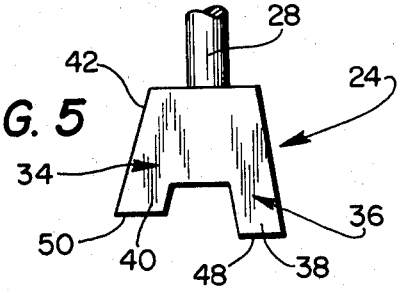
FIG. 5 is an end elevation view of the part illustrated in FIGS. 3 and 4.

Refer now to the drawings, and initially to FIGS. 1 and 2, which generally illustrate a golf putter 20 which embodies the principles of the present invention. For purposes of introduction, it is customary for a golfer to approach his ball as it lies on the green, then set his putter 20 such that its club head 24 rests on the ground 26 close to the ball, but such as to place the ball roughly between the putter and the hole (not shown). By reason of the invention, which will be described, the putter 20, when placed on the ground 26, has an automatic or inherent tendency to tip over or rotate forwardly and downwardly about the club head 24 (toward the left viewing FIG. 1) to the position indicated in FIG. 2.

In accordance with the invention, then, the golf putter 20 comprises a shaft having upper and lower ends and a longitudinal axis; a ball striking head mounted to said lower end of said shaft being generally defined by a forward member for striking a ball lying on the ground and a rear member opposite said forward member, said rear member terminating at a rear base which extends transverse of the longitudinal axis of said shaft, said forward member terminating at a forward base which extends transverse of the longitudinal axis of said shaft, an extremity of said forward base being nearer to said upper end of said shaft than an extremity of said rear base such that when said shaft is in an upright position and said rear base engages the ground, gravity tends to cause said shaft to rotate forwardly and downwardly about said rear base with said forward base tending to move toward engagement with the ground.

As embodied herein, and with particular reference now to FIGS. 1–5, the golf putter 20 is illustrated as including a shaft 28 having an upper end 30 and a lower end 32 and, inherently, a longitudinal axis (not shown).

The ball striking head 24 is suitably mounted to the lower end 32 of the shaft 28 in any suitable fashion. The ball striking head 24 is generally defined by a forward member 34 for striking the ball 22 as it rests on the ground 26 and a rear member 36 opposite the forward member 34. When the putter 20 assumes the address position, the forward member 34 and rear member 36 are positioned generally transverse to an imaginary line connecting the ball and the hole of the green. The rear member 36 terminates at its lower end at a rear base 38 which extends transverse of the longitudinal axis of the shaft 28. In a similar manner, the forward member 34 terminates at a forward base 40 which extends transverse of the longitudinal axis of the shaft 28 and, as particularly well seen in FIG. 5, an extremity of the forward base 40 is nearer to the upper end 30 of the shaft 28 than an extremity of the rear base 38.

With this construction of the ball striking head 24, it should now be readily apparent that when the putter 20 is placed on the ground 26 in a substantially upright manner (FIG. 1) the rear base 38 will first engage the ground. Gravity acting on the shaft 28, because of the uneven construction of the ball striking head 24, will tend to cause the shaft to pivot or rotate about the rear base 38 forwardly (to the left in FIG. 1) and downwardly about the rear base with the forward base 40 tending to move toward engagement with the ground. When the forward base 40 moves into engagement with the ground, the shaft 28 will have assumed the position indicated in FIG. 2 and the ball striking head 24 will be in the position indicated in FIG. 6.

The tendancy for the putter 20 to pivot or rotate from the upright position of FIG. 1 to the position of FIG. 2 can be further enhanced by removing a substantial amount of the material from the rear member 36 or by fabricating the striking head 24 of metals having different densities to achieve the same result. Specifically, it is within the purview of the invention to fabricate the forward member 34 of a heavy metal such as brass or bronze or the like while utilizing a lighter metal such as aluminum for fabrication of the rear member 36.

Figure 6:
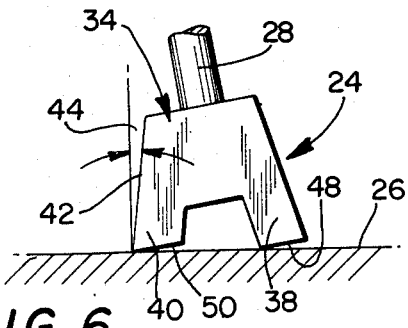
FIG. 6 is a side elevation view, similar to FIG. 5, illustrating the position of the part at address.

In accordance with the invention, the golf putter is generally as previously described wherein said forward member includes a planar ball striking face lying in a plane positioned within a range of 0° to 4° back from the vertical when said forward base and said rear base both engage the ground. As embodied herein, with continuing reference to FIG. 6, the forward member 34 includes a generally flat or planar face 42 which serves as the ball striking surface of the head 24. The face 42 lies in a plane which is desireably positioned within a range of 0° to 4° back from the vertical when the head 24 assumes the position illustrated in FIG. 6. An angle 44 is shown in FIG. 6 to represent this range of angles back from the vertical which is sometimes referred to as the ideal loft range for a golf putter. Thus, when the golf putter 20 assumes the position illustrated in FIG. 2, the ball striking face 42 is desireably positioned so as to provide a loft angle which is within this ideal range of angles.

In accordance with the invention, the golf putter is generally as previously described wherein said shaft includes a gripping handle adjacent said upper end, said gripping handle being positioned forward of said ball striking face when said forward base and said rear base both engage the ground. As embodied herein, with continuing reference to FIG. 2, the shaft 28 is seen to include a gripping handle 46 suitably applied to the shaft and positioned to receive the hands of the golfer. Located adjacent the end 30 of the shaft 28, the gripping handle 46, which may be composed of any suitable material, is positioned forward of the ball 22 when the forward base 40 and the rear base 38 both engage the ground (see FIG. 6).

In accordance with the invention, the golf putter is generally as previously described wherein said rear base terminates at a rear base surface and wherein said forward base terminates at a forward base surface, said forward base surface and said rear base surface each being planar and generally parallel to the ground when said shaft is in an upright position. As embodied herein, with particular reference to FIGS. 1 and 4–6, the rear base 38 is illustrated as terminating at a rear base surface 48 and the forward base 40 is seen to terminate at a forward base surface 50. Furthermore, each of the surfaces 48 and 50 are generally flat or planar and parallel to the ground when the shaft is in an upright position (FIG. 1).

Figure 7:
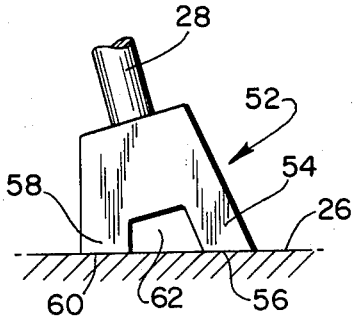
FIGS. 7–11 are all end elevation views, similar to FIG. 6, illustrating modified embodiments of the invention.
Figure 8:
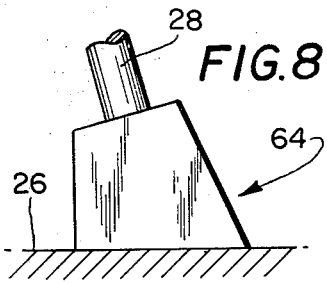
Figure 9:
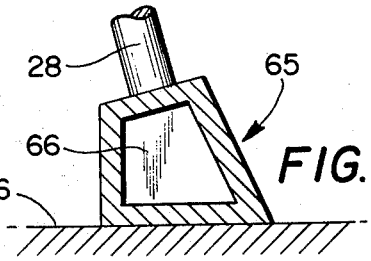

In accordance with the invention, the golf putter is generally as previously described wherein said rear base terminates at a rear base surface and wherein said forward base terminates at a forward base surface, said forward base surface and said rear base surface being planar and lying generally in a plane of the ground when said forward base and said rear base both engage the ground. As embodied herein, with particular reference now to FIG. 7, a modified ball striking head 52 is illustrated in which a rear base 54 terminates at a rear base surface 56 and in which a forward base 58 terminates at a forward base surface 60. In this embodiment, the forward base surface 60 and the rear base surface 56 are both planar and lie generally in a plane of the ground when the forward base 58 and the rear base 54 both engage the ground 26. With the configuration presented in this embodiment, scuffing of the ball striking head along the ground during putting is minimized by reason of the fact that the surfaces 56 and 60 are coplanar with the ground when the putter assumes the address position of FIG. 2. A channel 62 may be provided separating the bases 54 and 58 in order to achieve a desired mass distribution for the ball striking head 52. Other characteristics of the head 52 may be similar to those of the head 24. In FIG. 8, another modified ball striking head 64 is illustrated, similar to head 52, but solid and without any such channel. Still another modified ball striking head 65 is illustrated in FIG. 9 having the general characteristics just described with respect to heads 52 and 64, having solid or continuous outer surfaces, but an internal cavity 66 which may be suitably sized and positioned to achieve an optimum mass distribution for the head 65.

Figure 10:
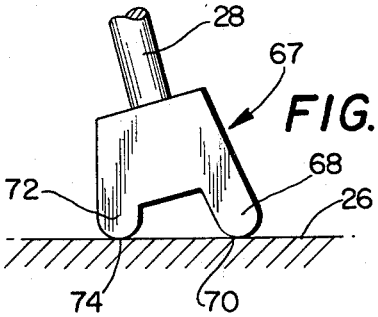

In accordance with the invention, the golf putter is generally as previously described wherein said rear base terminates at a rear base surface and wherein said forward base terminates at a forward base surface, said forward base surface and said rear base surface being curved and tangent to a plane of the ground when said forward base and said rear base both engage the ground. As embodied herein, with particular reference now to FIG. 10, yet another modified ball striking head 67 is illustrated as including a rear base 68 terminating at a rear base surface 70 and a forward base 72 terminating at a forward base surface 74. Each of the surfaces 70 and 74 are curved and tangent to a plane of the ground 26 when the forward base 72 and the rear base 68 both engage the ground. A desireable feature of this configuration is to improve the characteristics of the head 67 of the putter as it is drawn across the ground, specifically, to reduce scuffing or friction of the head and assure that a smooth stroke will be made.

Figure 11:
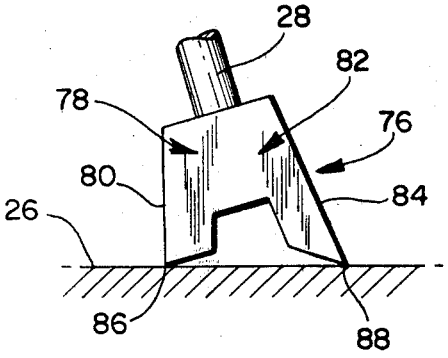

In accordance with the invention, the golf putter is generally as previously described wherein said forward member includes a planar ball striking face and said rear member includes a rear outer surface, said ball striking face terminating at a forward lower edge, said rear outer surface terminating at a rear lower edge, said forward lower edge being nearer to said upper end of said shaft than said rear lower edge. As embodied herein, with particular reference now to FIG. 11, still another embodiment of the invention is seen in the form of a ball striking head 76 in which a forward member 78 includes a planar ball striking face 80 and a rear member 82 includes a rear outer surface 84, the ball sriking face 80 terminating at a forward lower edge 86 and the rear outer surface 84 terminating at a rear lower edge 88. In this embodiment, the forward lower edge 86 is nearer to the upper end of the shaft 28 than the rear lower edge 88. The configuration of the ball striking head 76 may be desireable for the reason that, as illustrated, a minimal surface area is engageable with the ground by reason of the lower edges 86 and 88 with corresponding reduced scuffing or friction of the head as it is drawn across the ground.

In accordance with the invention, the golf putter is generally as previously described wherein said forward member includes a planar ball striking face terminating at a forward base and wherein said rear member includes a rear outer surface terminating at a rear base, said ball striking head including end surfaces intersecting with said ball striking face and with said rear outer surface, portions of said forward base and of said rear base being generally planar and portions thereof being relieved adjacent said end surfaces.

Figure 12:
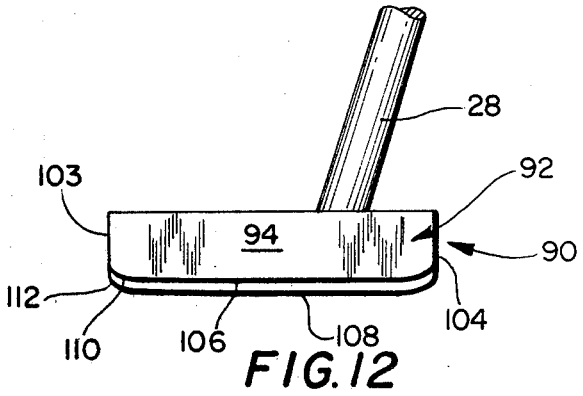
FIG. 12 is a front elevation view, similar to FIG. 4, of another modified embodiment of the invention.
Figure 13:
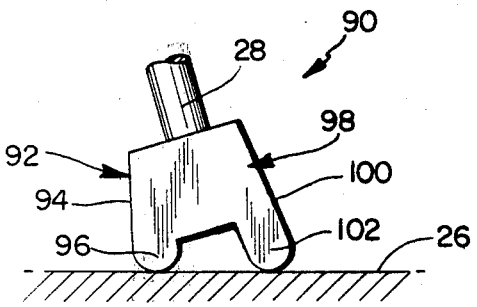
FIG. 13 is an end elevation view, similar to FIGS. 6–11, illustrating the embodiment shown in FIG. 12.

As embodied herein, with particular reference now to FIGS. 12 and 13, still another modified embodiment of the ball striking head is indicated by reference numeral 90 in which a forward member 92 includes a planar ball striking face 94 which terminates at a forward base 96 and wherein a rear member 98 includes a rear outer surface 100 terminating at a rear base 102. Additionally, the head 90 includes end surfaces 103 and 104 (FIG. 12) which respectively intersect with the ball striking surface 94 and with the rear outer surface 100. As illustrated in FIG. 12, the central portions 106 and 108 define extremities of the forward base 96 and rear base 102, respectively, which lie generally in a flat plane and having edges 110 and 112, respectively, which are relieved or curved adjacent to the end surfaces 103 and 104. The embodiment illustrated in FIGS. 12 and 13 provides a configuration which serves to improve the characteristics of the ball striking head by reducing the tendancy for scuffing as it is drawn across and through the grass of the green.

In accordance with the invention, the golf putter is generally as previously described wherein said ball striking head includes a web portion extending generally transverse of said shaft for receiving said lower end of said shaft, said forward member being integral with said web portion and wherein said rear member includes a generally u-shaped wire element having spaced apart side portions depending from said web portion and a bight portion, being said rear base, extending between said side portions.

Figure 14:
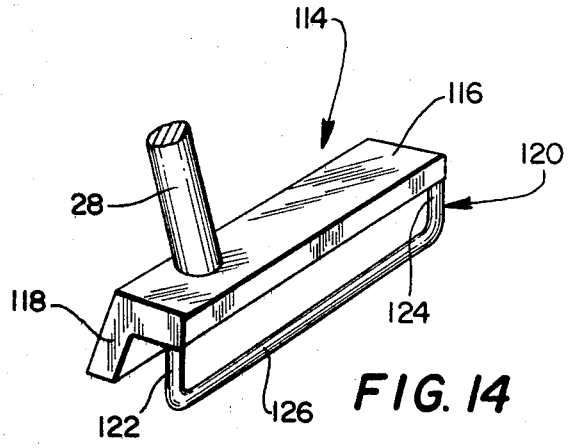
FIG. 14 is a detail perspective view of yet another modified embodiment of the invention.

As embodied herein, with particular reference now to FIG. 14, still another modified embodiment of the ball striking head is indicated generally by reference numeral 114 which includes a web portion 116 extending generally transverse of the shaft 28. The web portion 116 suitably receives the lower end 32 of the shaft such that the head 114 and the shaft 28 are effectively a single unit. A forward member 118, which may be similar to any of those forward members previously described, is integral with the web portion 116 and extends generally downwardly from the web portion when the putter is in the upright position illustrated in FIG. 1. A rear member 120 is also integral with the web portion 116 and is in the form of a generally u-shaped wire element having spaced apart side portions 122 and 124 suitably secured to the web portion 116 and depending therefrom and a bight portion 126 extending between the side portions 122 and 124 and effectively serving as a rear base for the ball striking head 114. As in the previous constructions described, an extremity of the forward member 118 is nearer to the upper end of the shaft 28 than an extremity of the bight portion 126. The construction of the ball striking head 114 is particularly effective in reducing the weight of the rear member 120 as compared to that of the forward member 118 to assure that a putter embodying such a construction would readily be caused to move from the position illustrated in FIG. 1 to that illustrated in FIG. 2.

The invention, in its broader aspects, is not limited to the specific details shown and described; departures may be made from such details without departing from the principles of the invention and without sacrificing its chief advantages.

What is claimed is:

1. A golf putter comprising:

a shaft having upper and lower ends and a longitudinal axis;

a ball striking head mounted to said lower end of said shaft being generally defined by a forward member for striking a ball lying on the ground and a rear member opposite said forward member, said rear member terminating at a rear base which extends transverse of the longitudinal axis of said shaft, said foward member terminating at a forward base which extends transverse of the longitudinal axis of said shaft, said forward base and said rear base defining between them a channel which extends transverse of the longitudinal axis of said shaft and generally parallel to said forward base and said rear base, an extremity of said forward base being nearer to said upper end of said shaft than an extremity of said rear base such that when said shaft is in an upright position and said rear base engages the ground, gravity tends to cause said shaft to rotate forwardly and downwardly about said rear base with said forward base tending to move toward engagement with the ground.

2. A golf putter as set forth in claim 1 wherein said forward member includes a planar ball striking face lying in a plane positioned within a range of 0° to 4° back from the vertical when said forward base and said rear base both engage the ground.

3. A golf putter as set forth in claim 2 wherein said shaft includes a gripping handle adjacent said upper end, said gripping handle being positioned forward of said ball striking face when said forward base and said rear base both engage the ground.

4. A golf putter as set forth in claim 1 wherein said rear base terminates at a rear base surface and wherein said forward base terminates at a forward base surface, said forward base surface and said rear base surface each being planar and generally parallel to the ground when said shaft is in an upright position.

5. A golf putter as set forth in claim 1 wherein said rear base terminates at a rear base surface and wherein said forward base terminates at a forward base surface, said forward base surface and said rear base surface being planar and lying generally in a plane of the ground when said forward base and said rear base both engage the ground.

6. A golf putter as set forth in claim 1 wherein said rear base terminates at a rear base surface and wherein said forward base terminates at a forward base surface, said forward base surface and said rear base surface being curved and tangent to a plane of the ground when said forward base and said rear base both engage the ground.

7. A golf putter as set forth in claim 1 wherein said forward member includes a planar ball striking face and said rear member includes a rear outer surface, said ball striking face terminating at a forward lower edge, said rear outer surface terminating at a rear lower edge, said forward lower edge being nearer to said upper end of said shaft than said rear lower edge.

8. A golf putter as set forth in claim 1 wherein said forward member includes a planar ball striking face terminating at a forward base and wherein said rear member includes a rear outer surface terminating at a rear base, said ball striking head including end surfaces intersecting with said ball striking face and with said rear outer surface, portions of said forward base and of said rear base being generally planar and portions thereof being relieved adjacent said end surfaces.

9. A golf putter as set forth in claim 1 wherein said ball striking head includes a web portion extending generally transverse of said shaft for receiving said lower end of said shaft, said forward member being integral with said web portion and wherein said rear member includes a generally u-shaped wire element having spaced apart side portions depending from said web portion and a bight portion, being said rear base, extending between said side portions.

* * * * *